US010718309B2

(12) United States Patent
Kawai

(10) Patent No.: US 10,718,309 B2
(45) Date of Patent: Jul. 21, 2020

(54) IGNITION COIL FOR INTERNAL COMBUSTION ENGINE

(71) Applicant: DENSO CORPORATION, Kariya (JP)

(72) Inventor: Kazuhide Kawai, Kariya (JP)

(73) Assignee: DENSO CORPORATION, Kariya (JP)

( * ) Notice: Subject to any disclaimer, the term of this patent is extended or adjusted under 35 U.S.C. 154(b) by 241 days.

(21) Appl. No.: 15/520,993

(22) PCT Filed: Oct. 22, 2015

(86) PCT No.: PCT/JP2015/079833
§ 371 (c)(1),
(2) Date: Apr. 21, 2017

(87) PCT Pub. No.: WO2016/063951
PCT Pub. Date: Apr. 28, 2016

(65) Prior Publication Data

US 2017/0342954 A1 Nov. 30, 2017

(30) Foreign Application Priority Data

Oct. 24, 2014 (JP) ..... 2014-217542

(51) Int. Cl.
*F02P 3/04* (2006.01)
*H01F 38/12* (2006.01)
(Continued)

(52) U.S. Cl.
CPC ..... *F02P 3/04* (2013.01); *F02P 13/00* (2013.01); *H01F 5/04* (2013.01); *H01F 27/022* (2013.01);
(Continued)

(58) Field of Classification Search
CPC ..... F02P 3/04; F02P 15/00; F02P 3/02; F02P 13/00; H01F 27/022; H01F 5/04;
(Continued)

(56) References Cited

U.S. PATENT DOCUMENTS

2014/0226253 A1* 8/2014 Kawai ..... F02P 3/02 361/263

FOREIGN PATENT DOCUMENTS

JP 2012-174829 9/2012
JP 5472814 4/2014

* cited by examiner

*Primary Examiner* — Joseph J Dallo
*Assistant Examiner* — Scott A Reinbold
(74) *Attorney, Agent, or Firm* — Nixon & Vanderhye P.C.

(57) ABSTRACT

An ignition coil for an internal combustion engine has a primary coil and a secondary coil, a case, a high voltage connection terminal, and a conduction terminal. The high voltage connection terminal is accommodated in the case in a state being sealed by a filling resin. The high voltage connection terminal is disposed in a state inclined an aligned direction of the secondary coil and the conduction terminal, and is configured to be elastically deformable. The conduction terminal includes an engaging part for engaging a terminal distal end portion of the high voltage connection terminal and a supporting part for supporting a terminal intermediate portion of the high voltage connection terminal which is a portion closer to a connecting portion with the secondary coil than the terminal distal end portion is. In the aligned direction, the terminal distal end portion contacts with the engaging part from a side opposite to a secondary coil side, and the terminal intermediate portion contacts with the supporting part from the secondary coil side.

7 Claims, 7 Drawing Sheets

(51) Int. Cl.

| | |
|---|---|
| ***H01T 13/05*** | (2006.01) |
| ***F02P 13/00*** | (2006.01) |
| ***H01F 27/02*** | (2006.01) |
| ***H01F 5/04*** | (2006.01) |
| ***H01F 27/28*** | (2006.01) |
| ***H01F 27/29*** | (2006.01) |

(52) U.S. Cl.
CPC ..... *H01F 27/28* (2013.01); *H01F 27/29* (2013.01); *H01F 38/12* (2013.01); *H01T 13/05* (2013.01)

(58) Field of Classification Search
CPC ..... H01F 27/29; H01F 27/28; H01F 38/12; H01F 2038/122; H01T 13/44
USPC ..... 123/634
See application file for complete search history.

IGNITION COIL FOR INTERNAL COMBUSTION ENGINE

This application is the U.S. national phase of International Application No. PCT/JP2015/079833 filed Oct. 22, 2015 which designated the U.S. and claims priority to JP Patent Application No. 2014-217542 filed Oct. 24, 2014, the entire contents of each of which are hereby incorporated by reference.

TECHNICAL FIELD

The present invention relates to an ignition coil for an internal combustion engine.

BACKGROUND ART

As an ignition coil for an internal combustion engine, there are those having a primary coil and a secondary coil magnetically coupled to each other, a high voltage connection terminal connected to the secondary coil, and a conduction terminal. The conduction terminal is in contact with the high voltage connection terminal and transmits a high voltage generated in the secondary coil to a spark plug. The primary coil and the secondary coil together with the high voltage connection terminal are accommodated in a case in a state of being sealed by a filling resin. In such an ignition coil, in order to make electrical conduction from the ignition coil to the spark plug, a reliable contact between the high voltage connection terminal and the conduction terminal is required.

Therefore, when manufacturing the ignition coil, in a state before filling the filling resin in the case, the high voltage connection terminal and the conduction terminal are brought into contact with each other, and are brought in a state where the high voltage connection terminal is urged toward the conduction terminal. Thereafter, the filling resin is filled from an opening of the case, and hardened. Thereby, it is possible to obtain the ignition coil in which the high voltage connection terminal is fixed in a state of being in contact with the conduction terminal.

Then, Patent Document 1 discloses that in order to further secure a contact between a high voltage connection terminal and a conduction terminal, two points of the high voltage connection terminal are contacted with a surface on a proximal end side (a surface on a primary coil and a secondary coil side) of the conduction terminal.

PRIOR ART

Patent Document

[Patent Document 1] Japanese Patent Application Laid-Open Publication No. 2012-174829

DISCLOSURE OF THE INVENTION

Problems to be Solved by the Invention

However, in recent years, an amount of heat generated by an ignition coil has increased as the ignition coil is requested to have a higher output, and a temperature change of the ignition coil tends to increase. Further, in recent years, a down-sizing of the ignition coil is required, but even with this, the change in the temperature of the ignition coil tends to be remarkable.

If the change in the temperature of the ignition coil becomes large, the filling resin may be displaced in a direction away from the case due to a difference in linear expansion coefficient between the case and the filling resin. At this time, the high voltage connection terminal is constrained by the filling resin in a hardened state. For this reason, it is conceivable that the high voltage connection terminal displaces in a direction away from the conduction terminal fixed to the case along with the displacement of the filling resin away from the case. As a result, there is a possibility that contact failure between the high voltage connection terminal and the conduction terminal may be caused.

The present invention has been made in light of the problems set forth above and has as its object to provide an ignition coil for an internal combustion engine with high connection reliability between a high voltage connection terminal and a conduction terminal.

Means for Solving the Problems

In one aspect of the present invention, an ignition coil for internal combustion engine includes a primary coil and a secondary coil magnetically coupled to each other, a case for accommodating the primary coil and the secondary coil, a high voltage connection terminal connected to the secondary coil, and a conduction terminal that is in contact with the high voltage connection terminal and transmits a high voltage generated in the secondary coil to a spark plug. The high voltage connection terminal together with the primary coil and the secondary coil are accommodated in the case in a state of being sealed with a filling resin. The high voltage connection terminal is disposed in a state inclined to an aligned direction of the secondary coil and the conduction terminal. The high voltage connection terminal is configured to be elastically deformable. The conduction terminal includes an engaging part for engaging a terminal distal end portion of the high voltage connection terminal and a supporting part for supporting a terminal intermediate portion of the high voltage connection terminal which is a portion closer to a connecting portion with the secondary coil than the terminal distal end portion is. In the aligned direction, the terminal distal end portion contacts the engaging part from a side opposite to a secondary coil side, and the terminal intermediate portion contacts the supporting part from the secondary coil side.

Effects of the Invention

In the ignition coil for the internal combustion engine, the conduction terminal has the engaging part and the supporting part. In the above-described aligned direction, the terminal distal end portion is in contact with the engaging part from the side opposite to the secondary coil side, and the terminal intermediate portion is in contact with the supporting part from the secondary coil side. Therefore, when a large temperature change occurs and the high voltage connection terminal constrained by the hardened filling resin is displaced to the secondary coil side the conduction terminal, the terminal distal end portion of the high voltage connection terminal are brought into contact with the engaging part more strongly. On the other hand, when the high voltage connection terminal constrained by the hardened filling resin is displaced to the side opposite to the secondary coil side the conduction terminal, the terminal intermediate portion of the high voltage connection terminal comes into contact with the supporting part more strongly.

In this manner, even if the high voltage connection terminal is displaced in any direction in the aligned direction, at least one of the terminal distal end portion and the terminal intermediate portion is maintained in contact with the conduction terminal. Thereby, the connection reliability between the high voltage connection terminal and the conduction terminal can be improved.

As described above, according to the present invention, it is possible to provide an ignition coil for an internal combustion engine having high connection reliability between a high voltage connection terminal and a conduction terminal.

MODE FOR CARRYING OUT THE INVENTION

In the present specification, in an aligned direction Z of a secondary coil and a conduction terminal, a secondary coil side is defined as a proximal end side, and a conduction terminal side is defined as a distal end side.

EMBODIMENTS

First Embodiment

An embodiment of an ignition coil for an internal combustion engine will be described with reference to FIGS. 1 to 7.

Figure 1:
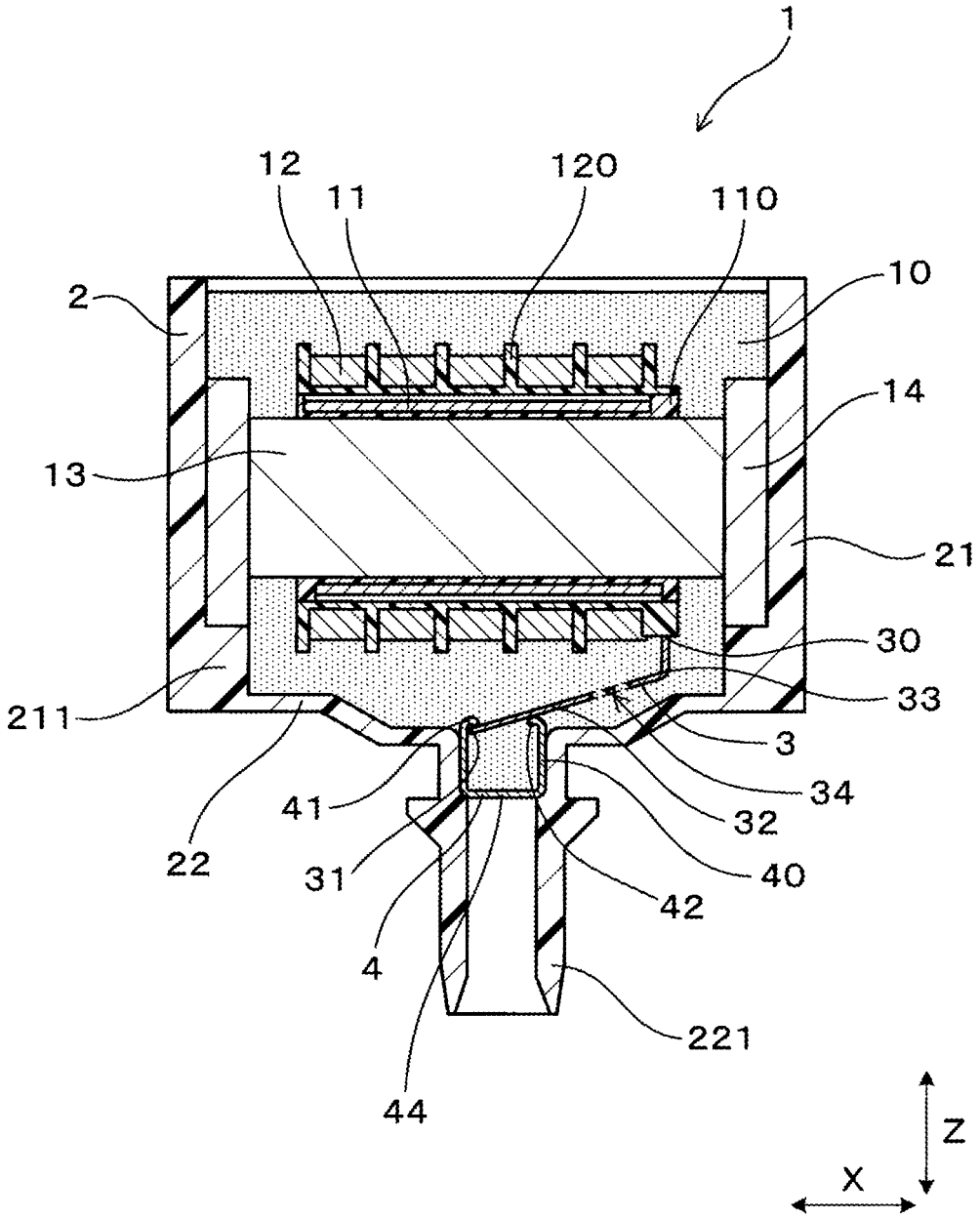
FIG. 1 shows a sectional view of an ignition coil for an internal combustion engine according to a first embodiment.

As shown in FIG. 1, an ignition coil 1 for an internal combustion engine of the present embodiment includes a primary coil 11 and a secondary coil 12 magnetically coupled to each other, a case 2 for accommodating the primary coil 11 and the secondary coil 12, a high voltage connection terminal 3 connected to the secondary coil 12, and a conduction terminal 4. The conduction terminal 4 is in contact with the high voltage connection terminal 3 and transmits a high voltage generated in the secondary coil 12 to a spark plug (not shown).

The high voltage connection terminal 3 is accommodated in the case 2 in a state of being sealed with a filling resin 10 together with the primary coil 11 and the secondary coil 12. The high voltage connection terminal 3 is disposed in a state inclined an aligned direction Z of the secondary coil 12 and the conduction terminal 4. Further, the high voltage connection terminal 3 is configured to be elastically deformable. It should be noted that in the following description, the aligned direction Z of the secondary coil 12 and the conduction terminal 4 is referred to simply as "an aligned direction Z" as appropriate.

Figure 2:
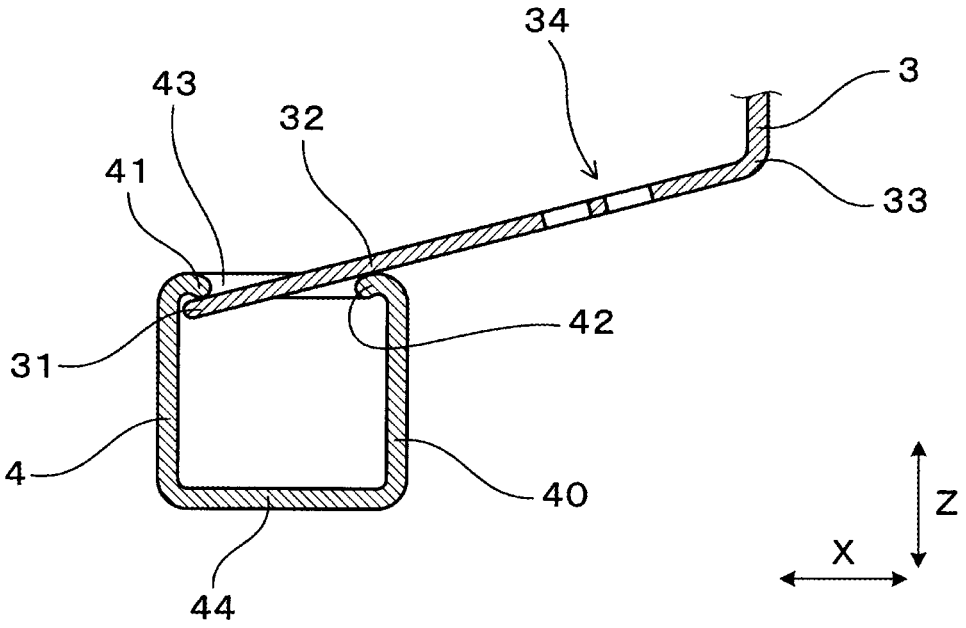
FIG. 2 shows an enlarged sectional view of a conduction terminal and a high voltage connection terminal according to the first embodiment.
Figure 3:
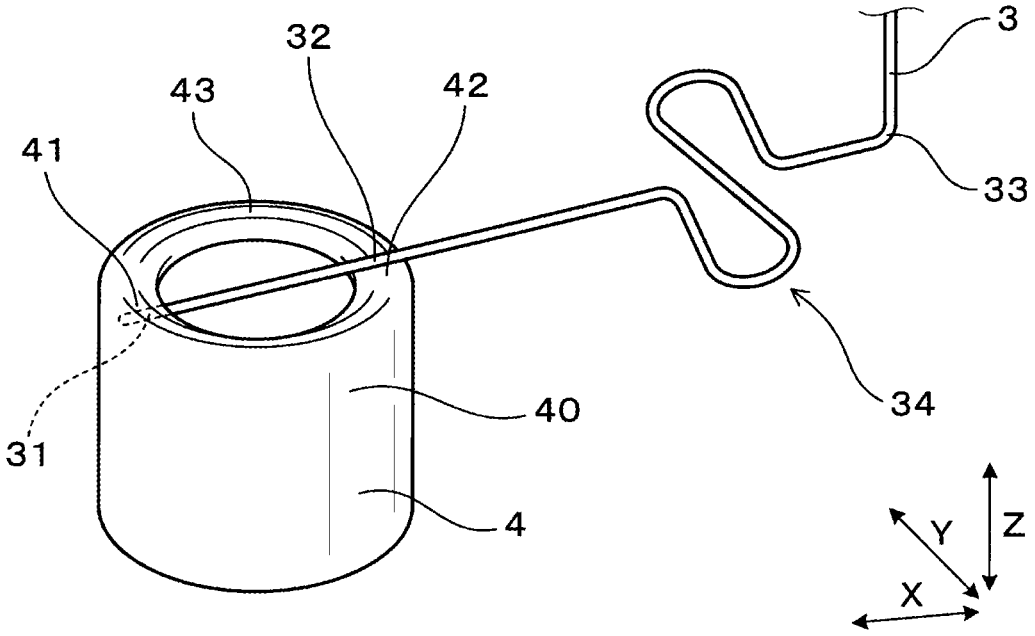
FIG. 3 shows an enlarged perspective view of the conduction terminal and the high voltage connection terminal according to the first embodiment.

As shown in FIGS. 1 to 3, the conduction terminal 4 includes an engaging part 41 for engaging a terminal distal end portion 31 of the high voltage connection terminal 3, and a supporting part 42 for supporting a terminal intermediate portion 32 of the high voltage connection terminal 3. Note that the terminal intermediate portion 32 is a portion which is disposed closer to the connecting portion 30 with the secondary coil 12 than the terminal distal end portion 31 is. In the aligned direction Z, the terminal distal end portion 31 is in contact with the engaging part 41 from a side opposite to a side of the secondary coil 12. Further, the terminal intermediate portion 32 is in contact with the supporting part 42 from the secondary coil 12 side.

As shown in FIG. 1, the primary coil 11 and the secondary coil 12 are concentrically disposed and are overlapped on inner and outer circumferences. The primary coil 11 is wound around a primary bobbin 110, and the secondary coil 12 is wound around a secondary bobbin 120 disposed on an outer peripheral side of the primary coil 11, thereby being formed in a substantially cylindrical shape. One end of the secondary coil 12 is connected to the primary coil 11 or a GND terminal (not shown) as a low voltage side. In addition, another end of the secondary coil 12 is connected to the connecting portion 30 of the high voltage connecting terminal 3 as a high voltage side.

Note that in the following description, a winding axis direction of the secondary coil 12 is defined as "an axial direction X". Further, a connecting portion 30 side of the high voltage connection terminal 3 in the axial direction X is defined as rearward, and an opposite side thereof is defined as frontward. Furthermore, a direction orthogonal to both the axial direction X and the aligned direction Z is defined as "a lateral direction Y".

The high voltage connection terminal 3 is formed by bending an elastically deformable metal wire material having a circular cross section. In the high voltage connection terminal 3, the connecting portion 30, which is one end portion, is supported by the secondary bobbin 120, and the terminal distal end portion 31, which is another end portion, and the terminal intermediate portion 32 are in contact with the conduction terminal 4. As shown in FIGS. 2 and 3, the high voltage connection terminal 3 extends from the connecting portion 30 toward the distal end side and is formed so as to extend obliquely forward at a bent portion 33. That is, a portion between the bent portion 33 and the terminal distal end portion 31 of the high voltage connection terminal 3 is inclined so as to head forward in the axial direction X as it goes to the distal end side in the aligned direction Z.

When assembling the ignition coil 1, the terminal distal end portion 31 of the high voltage connection terminal 3 is pressed toward the proximal end side to the engaging part 41, and the terminal intermediate portion 32 is pressed toward the distal end side of the supporting part 42 so as to be elastically deformed.

Further, as shown in FIG. 3, the high voltage connection terminal 3 has an elastic expansion-contraction structure 34 that enables elastic expansion and contraction in a longitudinal direction of the high voltage connection terminal 3. The elastic expansion-contraction structure 34 of the present embodiment has a serpentine shape formed by alternately bending toward both sides in the lateral direction Y. The elastic expansion-contraction structure 34 is formed between the bent portion 33 and the terminal intermediate portion 32 of the high voltage connection terminal 3.

As shown in FIGS. 2 and 3, the conduction terminal 4 has a tubular base portion 40. Further, the conduction terminal 4 forms the engaging part 41 and the supporting part 42 on the proximal end side of the base portion 40. In the present embodiment, the base portion 40 has a cylindrical shape. An annular inward portion 43 bent inward from the entire periphery of a proximal end portion is formed at the proximal end portion of the base portion 40. Then, a part of the annular inward portion 43 becomes the engaging part 41, and another part of the annular inward portion 43 becomes the supporting part 42.

A shape of the annular inward portion 43 viewed from the aligned direction Z is annular. The annular inward portion 43 is bent inward from the proximal end portion of the base portion 40 while bulging toward the proximal end side. That is, a surface on the proximal end side of the annular inward portion 43 is a convex curved surface. In the annular inward portion 43, a portion where the terminal distal end portion 31 abuts from the distal end side is the engaging part 41, and a portion where the terminal intermediate portion 32 abuts from the proximal end side is the supporting part 42. The engaging part 41 is positioned on a front side in the annular inward portion 43 and the supporting part 42 is positioned on a rear side in the annular inward portion 43. Further, the distal end portion of the base portion 40 is closed by a conduction bottom portion 44.

A proximal end side surface of the terminal distal end portion 31 of the high voltage connection terminal 3 is in contact with a distal end side surface of the engaging part 41 of the conduction terminal 4, and a distal end side surface of the terminal intermediate portion 32 of the high voltage connection terminal 3 is in contact with a proximal end side surface of the supporting part 42 of the conduction terminal 4. That is, the conduction terminal 4, the terminal distal end portion 31 of the high voltage connection terminal 3 is brought into contact with the engaging part 41 from the distal end side and the terminal intermediate portion 32 of the high voltage connection terminal 3 is brought into contact with the supporting part 42 from the proximal end side, and contacting surfaces of the conduction terminal 4 with the high voltage connection terminal 3 are on the opposite side in the aligned direction Z in the engaging part 41 and the supporting part 42. Then, when assembling the ignition coil 1, the high voltage connection terminal 3 is sealed with a resin by the filling resin 10, as shown in FIG. 1, in a state where the terminal distal end portion 31 is being urged to the engaging part 41 of the conduction terminal 4 disposed on the proximal end side thereof, and the terminal intermediate portion 32 is being urged to the supporting part 42 of the conduction terminal 4 disposed on the distal end side thereof.

As shown in FIG. 1, a central core 13 is disposed in an inner circumferential side of the primary bobbin 110 such that a longitudinal direction thereof is the axial direction X. Further, an outer peripheral core 14 is disposed so as to surround outer circumferences of the primary coil 11 and the secondary coil 12 from the axial direction X and the lateral direction Y. The outer peripheral core 14 is a substantially rectangular frame that opens in the aligned direction Z.

The case 2 surrounds peripheries of the primary coil 11 and the secondary coil 12, the center core 13, and the outer peripheral core 14 from a direction orthogonal to the aligned direction Z, and includes a side wall portion 21 that opens to the proximal end side, and a bottom wall portion 22 that closes the distal end side of the side wall portion 21. The side wall portion 21 has an engaging stepped portion 211 for engaging the outer peripheral core 14. A tower portion 221 to which the conduction terminal 4 is press-fitted inwardly is formed on the bottom wall portion 22 so as to protrude toward the distal end side. A high voltage conductor (not shown) is disposed in the tower portion 221 so as to be in contact with a distal end of the conduction terminal 4, thereby electrically connected to the spark plug.

Next, an example of a method of assembling the ignition coil 1 for the internal combustion engine of the present embodiment will be described.

Figure 4:
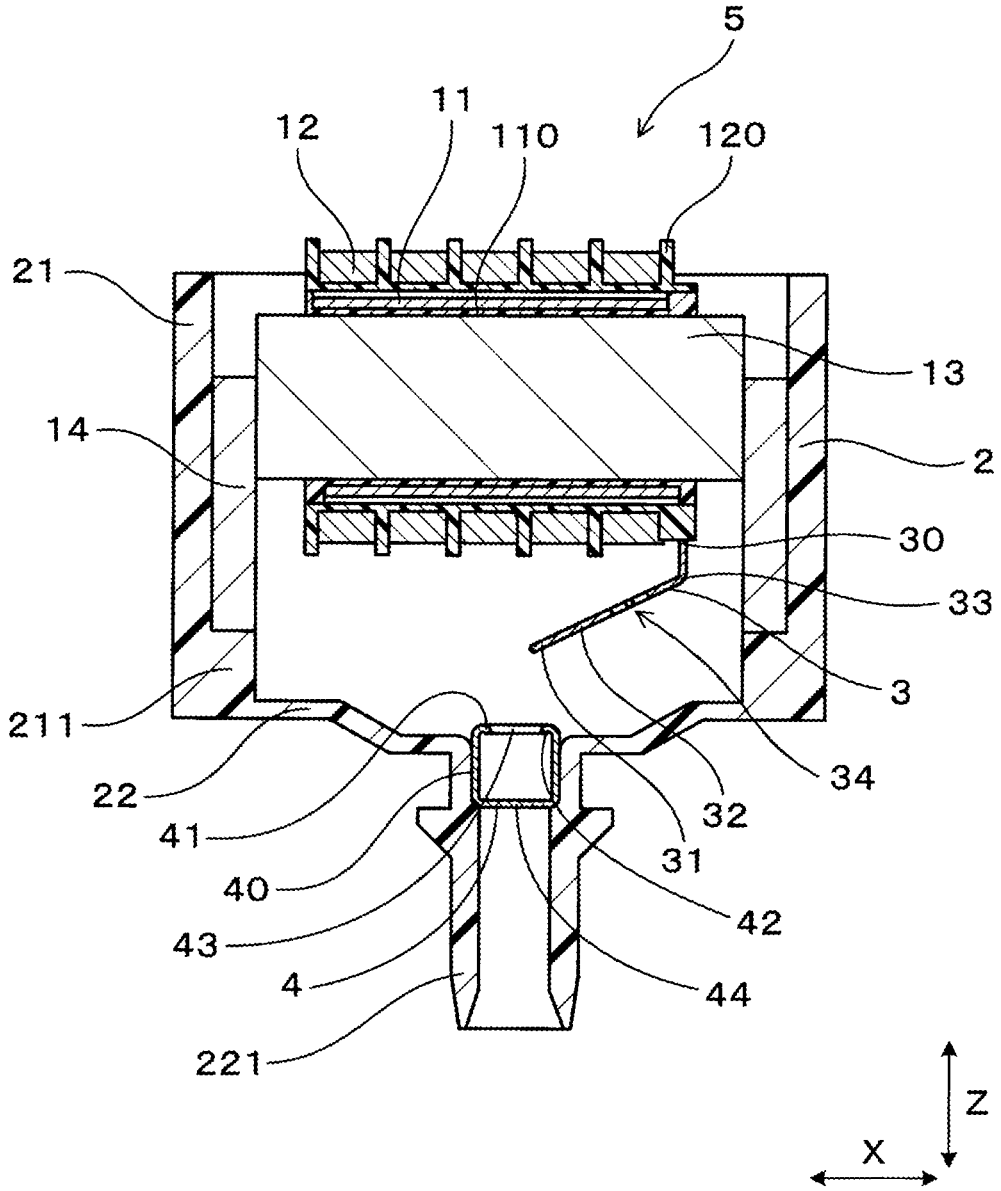
FIG. 4 shows a sectional view showing how a coil assembly is inserted and disposed in an outer peripheral core according to the first embodiment.
Figure 5:
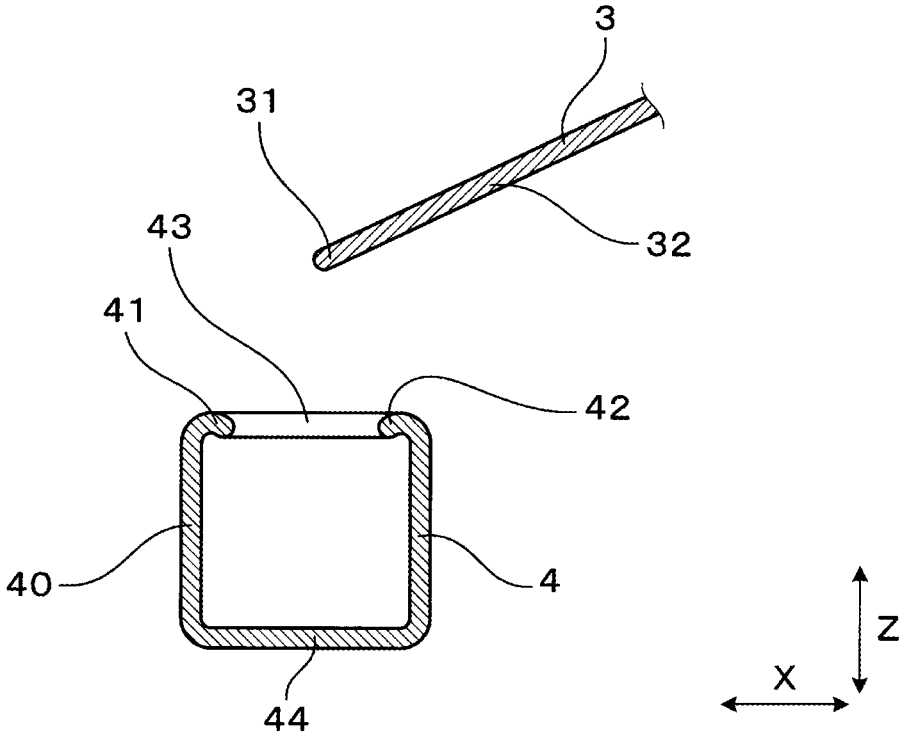
FIG. 5 shows an enlarged sectional view of the conduction terminal and the high voltage connection terminal showing a state before the high voltage connection terminal makes contact with the conduction terminal according to the first embodiment.

As shown in FIG. 4, a coil assembly 5 is formed by assembling the central core 13, the primary coil 11, and the secondary coil 12. The conduction terminal 4 is disposed in the case 2 by press-fitting it inside the tower portion 221 in a direction where the annular inward section 43 is positioned on the proximal end side. Further, the outer peripheral core 14 is disposed by being engaged with the engaging stepped portion 211 of the side wall portion 21 of the case 2.

Then, the coil assembly 5 is inserted into the case 2 from an opening direction toward the distal end side. At this time, as shown in FIG. 4, the coil assembly 5 is inserted into the case 2 while the central core 13 is made to follow the inner peripheral surface of the outer peripheral core 14.

Figure 6:
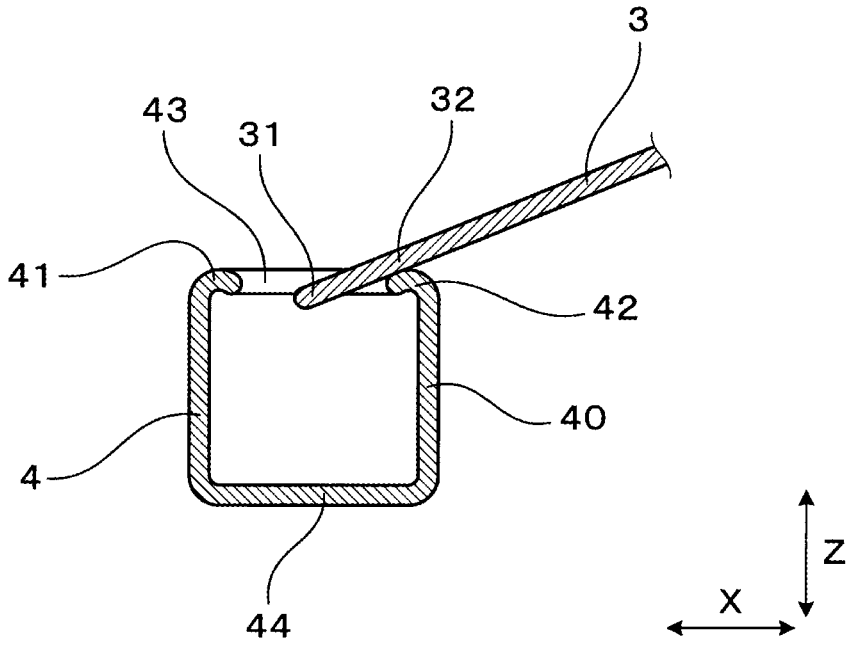
FIG. 6 shows an enlarged sectional view of the conduction terminal and the high voltage connection terminal showing a state in which the high voltage connection terminal is in contact with an annular inward portion of the conduction terminal according to the first embodiment.

Here, in a state before the high voltage connection terminal 3 abuts the conduction terminal (in a state of FIG. 5), a tip of the high voltage connection terminal 3 is positioned inside the conduction terminal 4 when viewed from the aligned direction Z. From this state, by further inserting the coil assembly 5 to the distal end side, a part of the high voltage connection terminal 3 and a part of the annular inward part 43 (the supporting part 42) of the conduction terminal 4 contact with each other as shown in FIG. 6.

Figure 7:
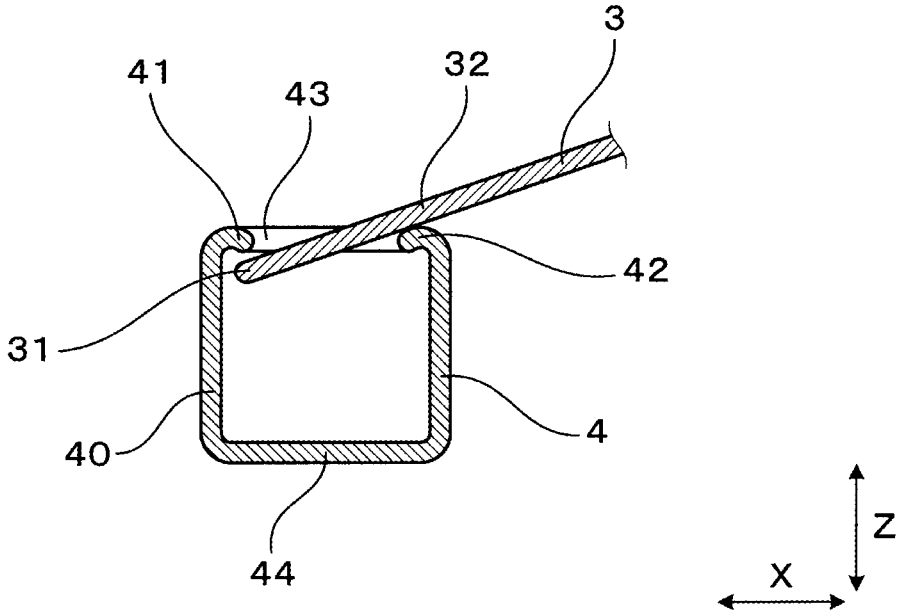
FIG. 7 shows an enlarged sectional view of the conduction terminal and the high voltage connection terminal showing how the high voltage connection terminal slides on the annular inward portion of the conduction terminal according to the first embodiment.

Then, as shown in FIG. 7, by further inserting the coil assembly 5 to the distal end side, while the high voltage connection terminal 3 is elastically deformed so that an inclination angle the axial direction X gradually decreases, the high voltage connection terminal 3 slides on the annular inward portion 43 (the supporting part 42) of the conduction terminal 4. At this time, since a surface on the proximal end side of the annular inward portion 43 is a curved surface, the high voltage connection terminal 3 can slide smoothly on the annular inward portion 43. Along with this, the terminal distal end portion 31 moves to the front side in the axial direction X and to the proximal end side in the aligned direction Z. Then, as shown in FIG. 7, the terminal distal end portion 31 is disposed at a position adjacent to the distal end side of the engaging part 41 of the conduction terminal 4.

When the coil assembly 5 is further inserted to the distal end side, the high voltage connection terminal 3 is further elastically deformed, the terminal distal end portion 31 moves to the proximal end side and is inserted into the distal end side of the engaging part 41 of the conduction terminal 4. Then, as shown in FIG. 2, the surface on the proximal end side of the terminal distal end portion 31 comes into contact with the distal end side surface of the engaging part 41 of the conduction terminal 4. By further inserting the coil assembly 5 to the distal end side, the terminal intermediate portion 32 is in a state of being urged toward the supporting part 42 of the annular inward portion 43, and the terminal distal end portion 31 is in a state of being urged toward the engaging part 41 of the annular inward portion 43.

In this state, the filling resin 10 is poured into the case 2 and is hardened to seal the coil assembly 5. Thereby, the ignition coil 1 for the internal combustion engine of the present embodiment can be obtained.

Next, functions and effects of the present embodiment will be described.

In the ignition coil 1 for the internal combustion engine, the conduction terminal 4 has the engaging part 41 and the supporting part 42. Then, in the aligned direction Z, the terminal distal end portion 31 contacts the engaging part 41 from the side opposite to the secondary coil 12 side, and the terminal intermediate portion 32 contacts the supporting part 42 from the secondary coil 12 side. Therefore, it is possible to improve connection reliability between the high voltage connection terminal 3 and the conduction terminal 4.

Further, the high voltage connection terminal 3 has an elastic expansion-contraction structure 34. Therefore, the terminal distal end portion 31 can be reliably engaged with the engaging part 41. That is, the length of the high voltage connection terminal 3 in the natural length is set long. Then, when bringing the high voltage connection terminal 3 into contact with the conduction terminal 4, the inclination angle of the high voltage connection terminal 3 the axial direction X is reduced while the terminal distal end portion 31 is brought into contact with the base body portion 40. Thereby, the terminal distal end portion 31 can be reliably engaged with the engaging part 41.

In addition, the conduction terminal 4 has the tubular base portion 40. Further, the conduction terminal 4 forms the engaging part 41 and the supporting part 42 on the proximal end side of the base portion 40. Therefore, it is possible to construct the ignition coil 1 which is easy to assemble the high voltage connection terminal 3 to the conduction terminal 4.

Further, the annular inward portion 43 bent inward from the entire periphery of the proximal end portion is formed at the proximal end portion of the base portion 40. The part of the annular inward portion 43 becomes the engaging part 41, and the other portion of the annular inward portion 43 becomes the supporting part 42. Thus, since arbitrary two positions in the annular inward portion 43 can be used as the engaging part 41 and the supporting part 42, the conduction terminal 4 can be easily formed, and the high voltage connection terminal 3 can be assembled easily to the conduction terminal 4.

As described above, according to the present embodiment, it is possible to provide an ignition coil for an internal combustion engine having high connection reliability between the high voltage connection terminal 3 and the conduction terminal 4.

Second Embodiment

Figure 8:
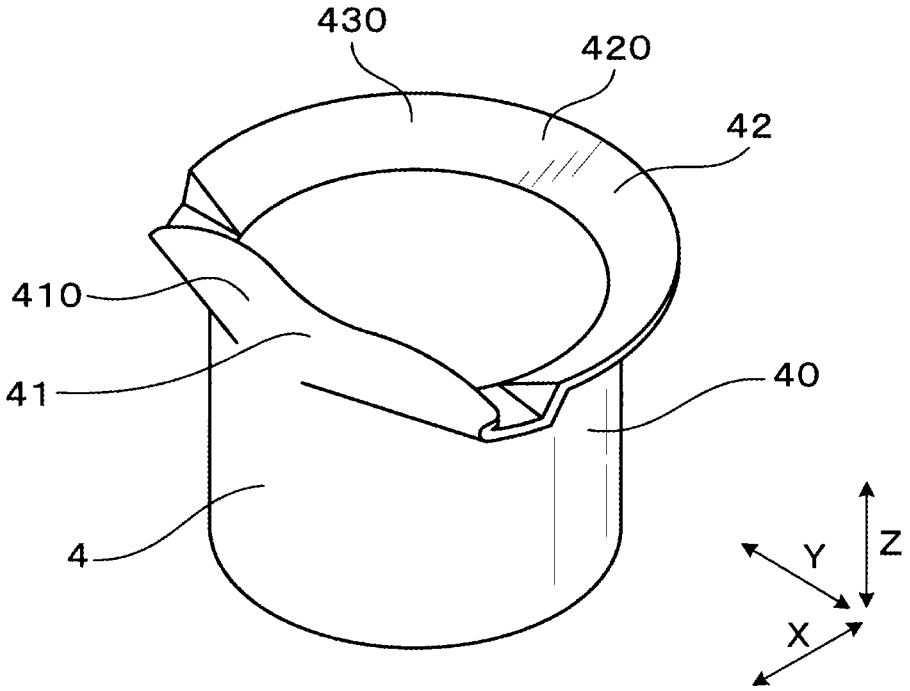
FIG. 8 shows a perspective view of a conduction terminal according to a second embodiment.
Figure 9:
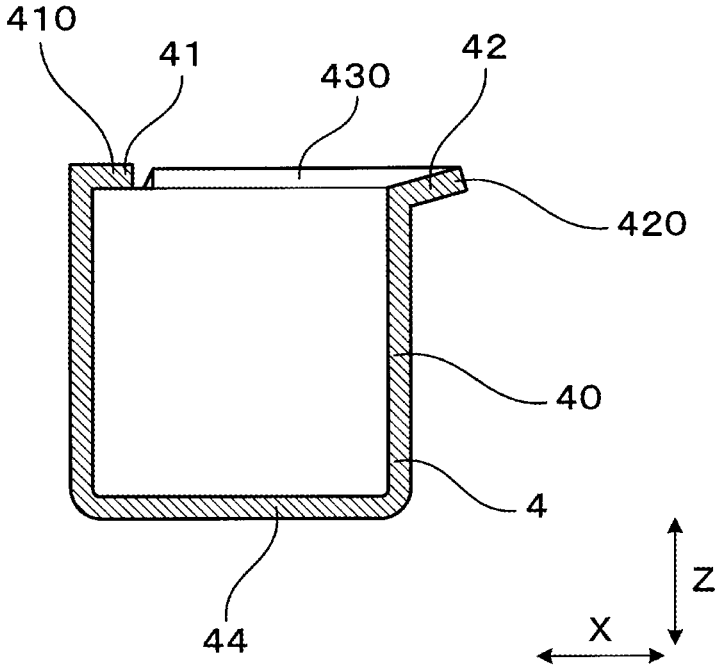
FIG. 9 shows a sectional view of the conduction terminal according to the second embodiment.

In the present embodiment, as shown in FIGS. 8 and 9, a shape of a conduction terminal 4 is changed that of the first embodiment.

In the present embodiment, an engaging part 41 is formed by a folded-back portion 410 that once protrudes outward from a base portion 40 and then is folded back inward. A supporting part 42 is formed by an outward inclined portion 420 which is inclined so as to expand outward from the base portion 40 toward the proximal end side. Note that another outward inclined portion 430 which is inclined so as to expand outward toward the proximal end side in the lateral direction Y also is formed on the proximal end side of the base portion 40. Inclination angles the axial direction X of the outward inclined portions 420*s* 430 are substantially equal to an inclination angle of a high voltage connecting terminal 3 the axial direction X.

The rest of the configuration is the same as in the first embodiment. It should be noted that among the reference numerals used in the present embodiment or the drawings relating to the present embodiment that are the same reference numerals as used in the first embodiment represent the same constituent elements and the like as in the first embodiment unless otherwise indicated.

In a case of the present embodiment, since the inclination angles of the supporting part 42 and the terminal intermediate portion 32 of the high voltage connection terminal 3 the axial direction X are equal to each other, the high voltage connection terminal 3 can be smoothly slid on the supporting part 42 of the conduction terminal 4.

Even in the present embodiment, it has the same functions and effects as the first embodiment.

Third Embodiment

Figure 10:
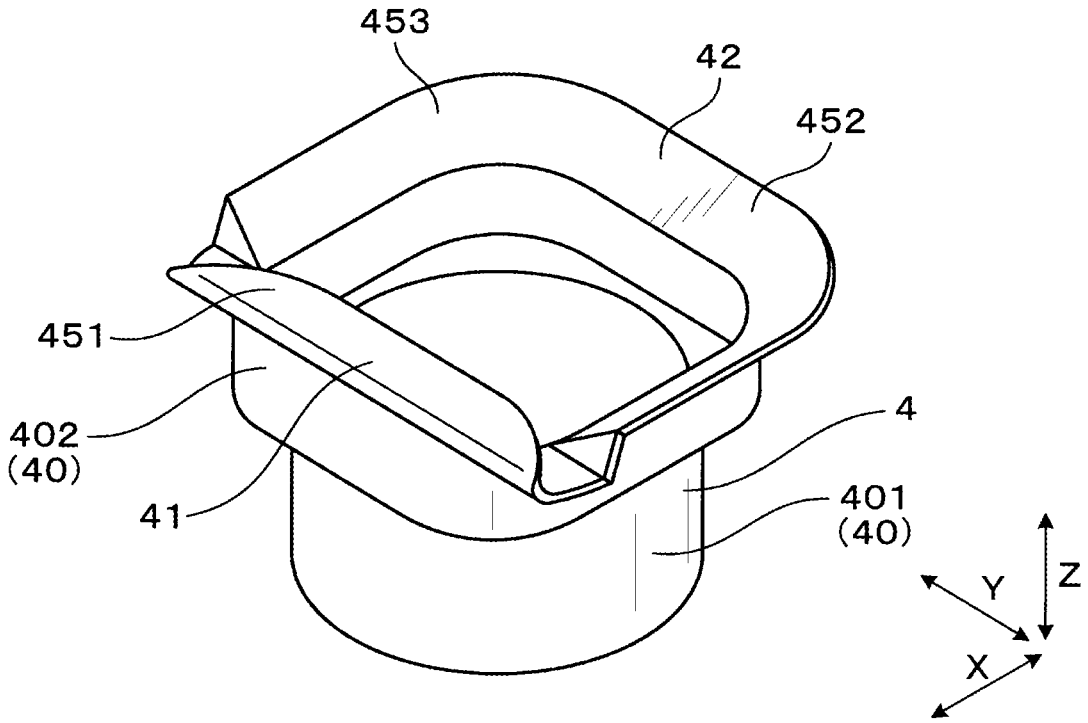
FIG. 10 is a perspective view of a conduction terminal according to a third embodiment.
Figure 11:
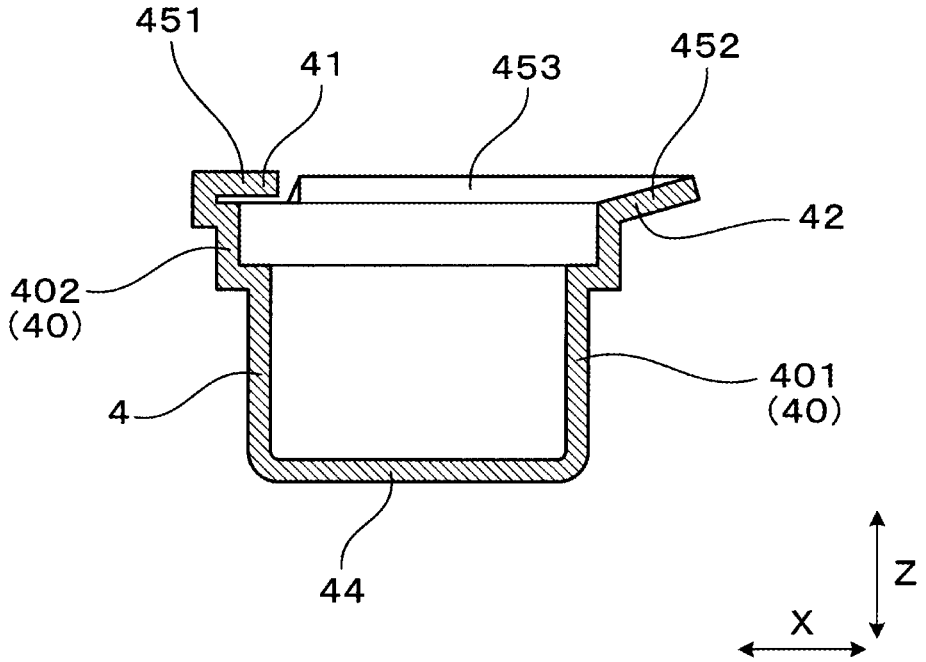
FIG. 11 is a sectional view of the conduction terminal according to the third embodiment.

In the present embodiment, as shown in FIGS. 10 and 11, a shape of a conduction terminal 4 is changed that of the first embodiment as well.

In the present embodiment, a base portion 40 of a conduction terminal 4 is composed of a base cylindrical portion 401 having a cylindrical shape and a base rectangular cylindrical portion 402 having a substantially rectangular cylindrical shape formed on the proximal end side of the base cylindrical portion 401. The base cylindrical portion 401 and the base rectangular cylindrical portion 402 are concentrically disposed. The base rectangular cylindrical portion 402 has four sides, and when viewed from the aligned direction Z, two opposing sides are formed in parallel with the axial direction X, and two other opposing sides are formed in parallel with the horizontal direction Y. The base cylindrical portion 401 is positioned inside the base rectangular cylindrical portion 402 when viewed from the aligned direction Z.

An engaging part 41 and a supporting part 42 are formed at the proximal end portion of the base rectangular cylindrical portion 402. The engaging part 41 is formed by a folded-back portion 451 that once protrudes outward from the base rectangular cylindrical portion 402 and then is folded back inward. The supporting part 42 is formed by an outward inclined portion 452 which is inclined so as to expand outward from the base rectangular cylindrical portion 402 toward the proximal end side. Note that outer inclined portions 453 are formed on two sides in the lateral direction Y of the proximal end portion of the base rectangular cylindrical portion 402 so as to go further outward toward the proximal end side as well.

The tower portion 221 of the case 2 is provided with a rectangular disposition section (not shown) in which the base rectangular tube section 402 is disposed. By fitting the base cylinder portion 401 to the tower portion 221 so that the base rectangular cylindrical portion 402 is disposed in the rectangular disposition section, the base rectangular cylindrical portion 402 can be prevented from rotating around the case 2.

The rest of the configuration is the same as in the second embodiment. It should be noted that among the reference numerals used in the present embodiment or the drawings relating to the present embodiment that are the same reference numerals as used in the second embodiment represent the same constituent elements and the like as in the second embodiment unless otherwise indicated.

In the present embodiment, since the base rectangular tubular portion 402 prevents the high voltage connection terminal 3 from rotating when assembling the ignition coil 1, the manufacture of the ignition coil 1 can be facilitated.

In addition, it has the same functions and effects as the second embodiment.

Although the base rectangular cylindrical portion 402 has a quarter-rotational symmetric shape when viewed from the aligned direction Z in the present embodiment, it is possible to prevent assembly errors from happening such that an assembling direction of the conduction terminal 4 is wrong by making the shape different from such a rotational symmetric shape (make one corner different in shape from other corners, for example).

Figure 12:
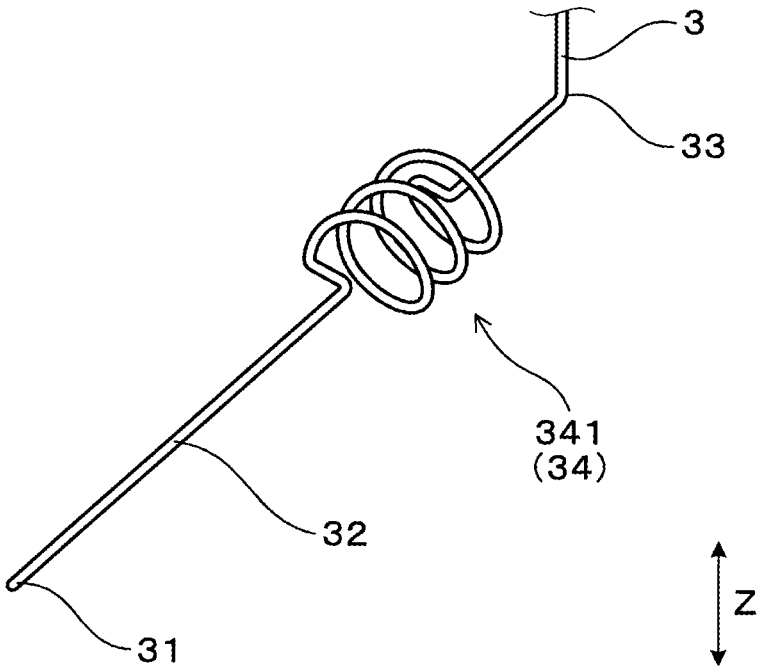
FIG. 12 is a perspective view showing another example of an elastic expansion-contraction structure.

Further, the present invention is not limited to the above-mentioned first to third embodiments, and various modes can be adopted. For example, the elastic expansion-contraction structure of the high voltage connection terminal 3 may be a coil spring 341 of which axis is a longitudinal direction of the high voltage connection terminal 3 as shown in FIG. 12.

REFERENCE SIGNS LIST

1: ignition coil for internal combustion engine
10: filling resin
11: primary coil
12: secondary coil
2: case
3: high voltage connection terminal
30: connecting portion
31: terminal distal end portion
32: terminal intermediate portion
4: conduction terminal
41: engaging part
42: supporting part
Z: aligned direction

The invention claimed is:

1. An ignition coil for an internal combustion engine comprising:

a primary coil and a secondary coil magnetically coupled to each other;

a case for accommodating the primary coil and the secondary coil;

a high voltage connection terminal connected to the secondary coil; and a conduction terminal that is in contact with the high voltage connection terminal and transmits a high voltage generated in the secondary coil to a spark plug; wherein, the high voltage connection terminal together with the primary coil and the secondary coil are accommodated in the case in a state of being sealed with a filling resin;

a position of the secondary coil and a position of the conduction terminal are aligned in a direction that is perpendicular to a longitudinal axis of the secondary coil;

the high voltage connection terminal is disposed in a state inclined with respect to the direction that is perpendicular to the longitudinal axis of the secondary coil;

the high voltage connection terminal is configured to be elastically deformable;

the conduction terminal includes an engaging part for engaging a terminal distal end portion of the high voltage connection terminal and a supporting part for supporting a terminal intermediate portion of the high voltage connection terminal which is a portion closer to a connecting portion with the secondary coil than the terminal distal end portion is;

in the direction that is perpendicular to the longitudinal axis of the secondary coil, the terminal distal end portion contacts the engaging part from a side opposite to a secondary coil side, and the terminal intermediate portion contacts the supporting part from the secondary coil side;

the conduction terminal includes a base portion having a proximal end portion;

an annular inward portion bent inward from an entire periphery of the proximal end portion is formed at the proximal end portion of the base portion;

a part of the annular inward portion forms the engaging part; and another part of the annular inward portion forms the supporting part.

2. The ignition coil for the internal combustion engine according to claim 1, wherein, the high voltage connection terminal has an elastic expansion-contraction structure that enables elastic expansion and contraction in a longitudinal direction of the high voltage connection terminal.

3. The ignition coil for the internal combustion engine according to claim 1, wherein, the conduction terminal has a base portion having a tubular shape; and the conduction terminal forms the engaging part and the supporting part on a proximal end side of the base portion.

4. The ignition coil for the internal combustion engine according to claim 2, wherein, the conduction terminal has a base portion having a tubular shape; and the conduction terminal forms the engaging part and the supporting part on a proximal end side of the base portion.

5. The ignition coil for the internal combustion engine according to claim 3, wherein, an annular inward portion bent inward from an entire periphery of a proximal end portion is formed at the proximal end portion of the base portion; and a part of the annular inward portion is the engaging part and another part of the annular inward portion is the supporting part.

6. The ignition coil for the internal combustion engine according to claim 4, wherein, an annular inward portion bent inward from an entire periphery of a proximal end portion is formed at the proximal end portion of the base portion; and a part of the annular inward portion is the engaging part and another part of the annular inward portion is the supporting part.

7. The ignition coil for the internal combustion engine according to claim 1, wherein the base portion has a cylindrical shape.

* * * * *